US005231965A

United States Patent [19]

Muzzy

[11] Patent Number: 5,231,965

[45] Date of Patent: Aug. 3, 1993

[54] THROTTLE SIGNAL MODIFYING CIRCUIT

[75] Inventor: Norman E. Muzzy, Cedar Falls, Iowa

[73] Assignee: Deere & Company, Moline, Ill.

[21] Appl. No.: 980,077

[22] Filed: Nov. 23, 1992

[51] Int. Cl.[5] ..... F02D 9/06; F02D 31/00

[52] U.S. Cl. ..... 123/325; 123/358

[58] Field of Search ..... 123/325, 333, 357, 358, 123/494; 414/526

[56] References Cited

U.S. PATENT DOCUMENTS

| | | | |
|---|---|---|---|
| 3,407,793 | 10/1968 | Lang | 123/358 |
| 3,425,401 | 2/1969 | Lang | 123/357 |
| 3,570,460 | 3/1971 | Rados | 123/333 |
| 3,672,345 | 6/1972 | Monpetit | 123/325 |
| 3,867,918 | 2/1975 | Williams | 123/357 |
| 4,083,267 | 4/1978 | Raaz | 123/325 |
| 4,177,788 | 12/1979 | Morita | 123/325 |
| 4,305,359 | 12/1981 | Mann | 123/333 |
| 4,466,392 | 8/1984 | Uchida | 123/333 |
| 4,522,553 | 6/1985 | Nelson et al. . | |
| 4,599,695 | 7/1986 | Deotsch | 123/325 |
| 4,633,831 | 1/1987 | Ohkumo | 123/325 |

*Primary Examiner*—Carl S. Miller

[57] ABSTRACT

An engine governor system includes an electronic governor which controls the fuel supply to an engine in response to an throttle signal supplied by a throttle potentiometer which coupled to a throttle lever. A circuit is connected between the throttle potentiometer and a potential source. The circuit includes a normally closed foot-operated deceleration switch connected in parallel with a first variable resistor, both connected in series with a third variable resistor. Closing the foot-operated switch will reduce the throttle signal by an amount controlled by the adjustment of the first variable resistor. The maximum possible throttle signal can be controlled by the adjustment of the second variable resistor.

2 Claims, 1 Drawing Sheet

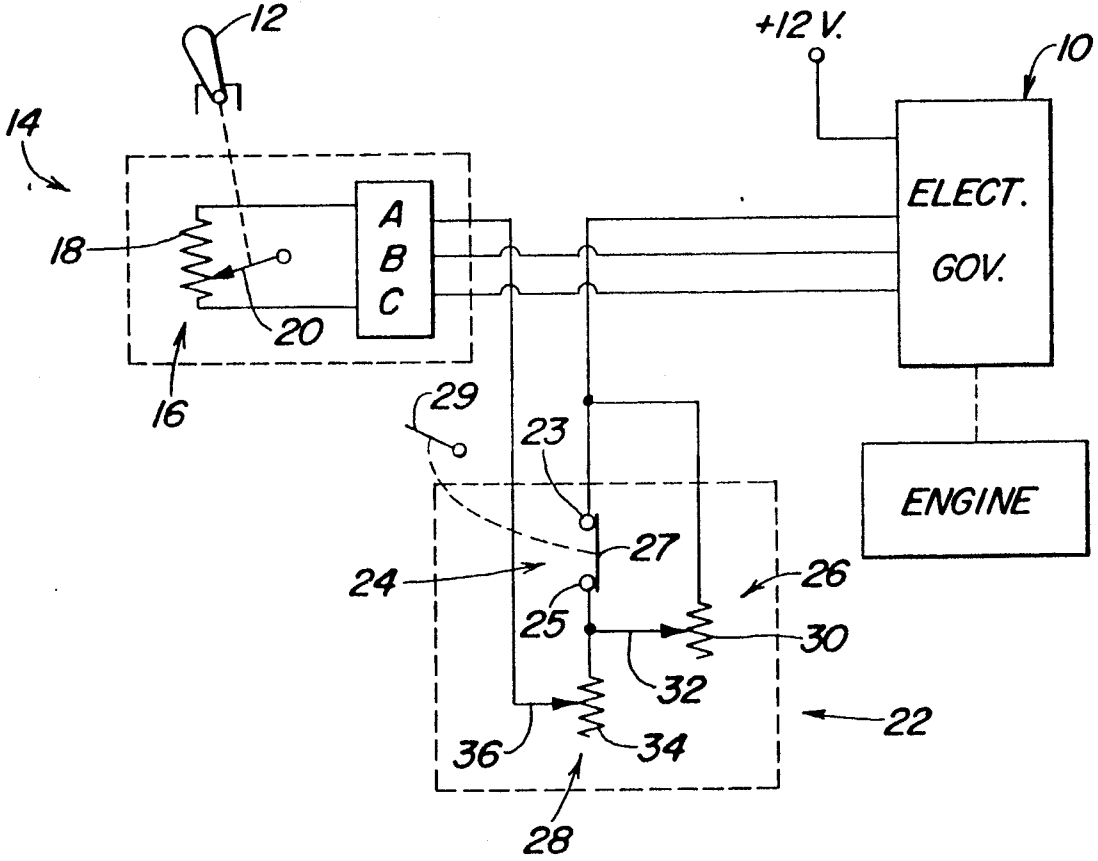
10
ELECT.
GOV.
ENGINE
+12 V.
22
26
30
32
34
27
23
25
28
36
29
24
A
B
C
20
12
16
18
14

THROTTLE SIGNAL MODIFYING CIRCUIT

BACKGROUND OF THE INVENTION

This invention relates to an engine governor system having an electronic governor.

It is known to control an engine with an operator controlled throttle device having a throttle position sensor which includes a potentiometer with a resistor element and a tap element which provides a ratiometric throttle signal to the electronic governor. In such a system the tap element generates a variable magnitude throttle control signal which is utilized by the electronic governor. It would be desirable to provide such a system with a means to temporarily modify or reduce the magnitude of the throttle control signal without having to manipulate the throttle lever. It would also be desirable to provide such a system with a means to modify or adjust the maximum the magnitude of the throttle control signal without having to physically limit the motion of the throttle lever.

SUMMARY OF THE INVENTION

Accordingly, an object of this invention is to provide an electronic governor system with a means to temporarily modify or reduce the magnitude of the throttle control signal without having to manipulate the throttle lever.

A further object of the invention is to provide such a system with a means to modify or adjust the maximum the magnitude of the throttle control signal without having to physically limit the motion of the throttle lever These and other objects are achieved by the present invention, wherein an engine governor system includes an electronic governor which controls the fuel supply to an engine in response to an throttle signal supplied by a throttle potentiometer which coupled to a throttle lever. A circuit is connected between the throttle potentiometer and a potential source. The circuit includes a foot-operated normally closed deceleration switch connected in parallel with a first variable resistor, both connected in series with a third variable resistor. Closing the foot-operated switch will reduce the throttle signal by an amount controlled by the adjustment of the first variable resistor. The maximum possible throttle signal can be controlled by the adjustment of the second variable resistor.

BRIEF DESCRIPTION OF THE DRAWINGS

The sole FIGURE is a schematic circuit diagram illustrating the present invention.

DETAILED DESCRIPTION

A known engine governor system, such as available on the Model 8760 four wheel drive tractors manufactured by John Deere, includes an electronic governor 10 which controls the fuel supply to an engine (not shown) in response to various inputs, including a conventional operator controlled throttle device 12. In this known system a conventional throttle position sensor 14 provides to the electronic governor 10 a signal representing the position of the throttle device 12. The throttle position sensor 14 includes a throttle potentiometer 16 with a resistor element 18 and a tap element 20. The resistor element 18 having one side for connecting to a +5 volt potential source and a second side connected to ground potential. In this manner, a variable voltage is applied to the tap element 20 and the governor 10 utilizes this signal to control engine speed in the usual manner.

According to the present invention, an additional circuit 22 is connected between the throttle potentiometer 16 and the +5 volt potential source. Circuit 22 includes a normally closed deceleration switch 24, a deceleration variable resistor 26 and a maximum speed variable resistor 28. Switch 24 has a first terminal 23 connected to the potential source; a second terminal 25 and a contact element 27. Preferably, the contact element 27 is connected to an operator controlled device 29, such as a foot operated device 29. Variable resistor may be formed by a conventional rotary potentiometer with a 5k ohm resistor element 30 and a tap element 32. The resistor element 30 has one side connected to the +5 volt potential source and a second side which is unconnected. The tap element 32 is connected to the second terminal 25 of the normally closed switch 24.

Variable resistor 28 may be formed by a conventional rotary potentiometer which includes a 5k ohm resistor element 34 and a tap element 36. The resistor element 34 has one side connected to the second terminal 25 of the switch 24 and a second side which is unconnected. The tap element 36 is connected to the one side of the resistor element 18 of the throttle potentiometer 16. The shafts (not shown) of both of the rotary potentiometers may connected to manually operable control knobs (not shown).

MODE OF OPERATION

Normally, the switch 24 is closed and the tap element 36 is in the position shown. In this case, the full +5 volt potential is supplied from the governor 10 to the throttle potentiometer 16 via switch 24, and the resistor elements 30 and 34 are bi-passed. As a result, the full potential is supplied to the throttle potentiometer 16.

Now, if the operator desires to temporarily decrease the speed of the engine (not shown) the switch 24 is opened by pressing on the device 29. The +5 volt potential source will now be supplied to the throttle potentiometer 16 via a portion of the variable resistor 26 and via tap elements 32 and 36. This reduces the current flowing through the resistor element 18 of the throttle potentiometer 16 and thus decreases the voltage signal applied to the tap element 20 and thus to the governor 10. This can be accomplished without changing the setting of the throttle lever 12, so that, when the switch 24 is re-closed the original setting of the lever 12 will become effective. The amount of this temporary deceleration can be adjusted by adjusting the variable resistor 26.

The variable resistor 28 can be adjusted to reduce current flow to the throttle potentiometer 16 regardless of whether switch 24 is opened or closed. Thus, variable resistor 28 can be used to lower the maximum possible signal provided by tap 20 of throttle potentiometer 16 to the governor 10.

While the present invention has been described in conjunction with a specific embodiment, it is understood that many alternatives, modifications and variations will be apparent to those skilled in the art in light of the foregoing description. Accordingly, this invention is intended to embrace all such alternatives, modifications and variations which fall within the spirit and scope of the appended claims.

What is claimed is:

1. In an engine governor system having an electronic governor, an operator controlled throttle device and a throttle position sensor coupled to the throttle device and connected to inputs of the electronic governor, the throttle position sensor comprising a throttle potentiometer connected to a potential source and with a tap element generating a variable magnitude throttle signal which is utilized by the electronic governor, the engine governor system also having modifying means coupled between the potential source and the throttle potentiometer for modifying the throttle signal supplied by the tap element of the throttle potentiometer, the improvement wherein the modifying means comprises:

a normally closed switch having a first terminal connected to the potential source and a second terminal coupled to the throttle potentiometer; and a first variable resistor connected between the first and second terminals of the normally closed switch.

2. The invention of claim 1, further comprising:

a second variable resistor connected between the second terminal of the switch and the throttle position sensor.

* * * * *